US008282468B2

(12) United States Patent
Huntley et al.

(10) Patent No.: US 8,282,468 B2
(45) Date of Patent: Oct. 9, 2012

(54) SYSTEM AND METHOD FOR GAMING TERMINAL WITH ACCOUNT FUNDING

(75) Inventors: William J Huntley, Cumming, GA (US); Aman Safaei, Alpharetta, GA (US); Brooks H Pierce, Wilmington, DE (US); Louis F Skelton, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 987 days.

(21) Appl. No.: 11/999,259

(22) Filed: Dec. 4, 2007

(65) Prior Publication Data

US 2008/0153583 A1 Jun. 26, 2008

Related U.S. Application Data

(60) Provisional application No. 60/868,378, filed on Dec. 4, 2006.

(51) Int. Cl.
*A63F 9/24* (2006.01)

(52) U.S. Cl. ..... 463/25; 463/29

(58) Field of Classification Search ..... 463/25, 463/29

See application file for complete search history.

(56) References Cited

U.S. PATENT DOCUMENTS 4,108,361 A 8/1978 Krause
4,856,787 A * 8/1989 Itkis ..... 273/237
5,038,022 A * 8/1991 Lucero ..... 463/25
5,408,417 A 4/1995 Wilder
5,457,306 A 10/1995 Lucero
5,464,971 A 11/1995 Sutcliffe et al.
5,830,068 A 11/1998 Brenner et al.
6,004,211 A 12/1999 Brenner et al.
6,089,981 A 7/2000 Brenner et al.
6,099,408 A * 8/2000 Schneier et al. ..... 463/29
6,099,409 A 8/2000 Brenner et al.
6,296,251 B1 * 10/2001 Webb ..... 273/292
6,554,708 B1 4/2003 Brenner et al.
6,554,709 B1 4/2003 Brenner et al.

(Continued)

FOREIGN PATENT DOCUMENTS

EP 0 805 424 A 11/1997

OTHER PUBLICATIONS

PCT International Search Report for PCT/US2007/024839, Aug. 7, 2008.

*Primary Examiner* — Omkar Deodhar
(74) *Attorney, Agent, or Firm* — Dority & Manning, P.A.

(57) ABSTRACT

A system and method for providing a terminal with account funding is described. In one exemplary aspect of the invention, a system is provided having an interface whereby a player can interact with the gaming system. The interface allows the player to request a transfer of funds from the player's bank account to a wagering account. The system prompts the player to provide for reading the player's bank card such as by swiping the card. The system receives the player's entry of a personal identification code and sends information concerning the player's request for a transfer to a bank. The system then reports the bank's response to the player's request and, if allowed, credits that player's wagering account with the requested transfer of funds.

18 Claims, 15 Drawing Sheets

U.S. PATENT DOCUMENTS

| | | | | |
|---|---|---|---|---|
| 6,575,834 | B1 | 6/2003 | Lindo | |
| 6,585,598 | B2 * | 7/2003 | Nguyen et al. | 463/41 |
| 6,712,698 | B2 * | 3/2004 | Paulsen et al. | 463/30 |
| 6,741,897 | B1 | 5/2004 | Lallemant | |
| 7,206,762 | B2 | 4/2007 | Sireau | |
| 2002/0002075 | A1 | 1/2002 | Rowe | |
| 2003/0060286 | A1 * | 3/2003 | Walker et al. | 463/42 |
| 2005/0021492 | A1 | 1/2005 | Safaei et al. | |

* cited by examiner

SYSTEM AND METHOD FOR GAMING TERMINAL WITH ACCOUNT FUNDING

PRIORITY CLAIM

The present application claims priority to U.S. Provisional Application Ser. No. 60/868,378, filed Dec. 4, 2006.

BACKGROUND OF THE INVENTION

Wagering terminals such as the Scientific Games PROBE™ are used by patrons at OTBs (off track betting) or other venues to place wagers on parimutuel events such as horse or greyhound races. As is known to those skilled in the art, the terminals communicate with the OTB's or venue's totalisator to place wagers on individual or multiple races (or games e.g., in the case of Jai-Lai). Details of the operation of these wagering terminals and the totalisators are known in the art and need not be detailed herein.

Paper and cash reliance in the industry leads to arduous accounting, increased risk of fraud, and adds significantly to operational overhead expenses. It is desirable to significantly reduce or eventually eliminate the need for paper-based terminals such as the PROBE™ terminal to handle wagers. In pursuit of this goal, there is a desire to promote account wagering, via either temporary or permanent accounts, and to make account wagering the norm by which all patrons place bets.

As described hereafter, in order to create a truly paperless environment, the inventive terminals and system described herein provide ATM/debit/credit/EDI or equivalent card services to transfer funds between bank and wagering accounts and to provide full account wagering functionality.

SUMMARY OF THE INVENTION

A summary of exemplary embodiments and methods of the present invention will be set forth here. Using the description provided herein, one skilled in the art will understand that additional exemplary embodiments and methods are within the scope of the present invention.

In one exemplary aspect, the present invention provides a method for funding players of a gaming system that includes the steps of providing an interface whereby a player can interact with the gaming system, allowing the player to request a transfer of funds from a bank account to a wagering account, reading a bank card (e.g., debit card, credit card, check card, etc.) provided by the player, receiving the entry of a personal identification code (e.g. a PIN), sending information regarding the player's request for a transfer of funds to a bank, and reporting to the player the bank's response to the player's request for a transfer of funds. The interface may include a terminal with an associated keypad for entry of information by the player or operator. The interface may include a terminal, screen or other device for indicating to the player the amount of funds in the wagering account. This exemplary method can provide for reading the bank card by a number of methods including allowing the player to swipe the bank card using the interface. The method can also include a step of sending information regarding the player's request for a transfer of funds to a bank by sending the information to a payment processor. Depending upon a gaming operator's preferences, the method may include a step for verifying the player's wagering account credentials. Steps may also be provided for crediting the wagering account with the amount of the player's request for a transfer of funds from the bank account, crediting the wagering account with an amount based on the player's winnings, and transferring funds from the wagering account to the bank account. The interface may also provide the player with various gaming information. The method may also include one or more steps for classifying the information provided by a player as public, confidential, or otherwise.

In another exemplary embodiment, the present invention includes a terminal operating according to the methods summarized above.

In another exemplary embodiment, the present invention includes a computer program product including instructions embodied on a computer readable storage medium, the computer program product acting to allow for funding players of a gaining system. The computer program includes allowing instructions for allowing a player to request a transfer of funds from a bank account to a wagering account; reading instructions for reading a player's bank card; receiving instructions for receiving the entry of a personal identification code; sending instructions for sending information regarding the player's request for a transfer of funds to a bank; and reporting instructions for reporting to the player the bank's response to the player's request for a transfer of funds.

In another exemplary embodiment, the present invention provides a wagering device with account funding that includes a terminal configured for displaying a graphical user interface, the interface comprising prompts by which a player may request a transfer of funds from a bank account to a wagering account; a host in charge configured for providing gaming services; and a network connecting the terminal and the host in charge, the network configured for communicating with a bank at which the bank account is provided.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE PREFERRED EMBODIMENTS

Figure 1:
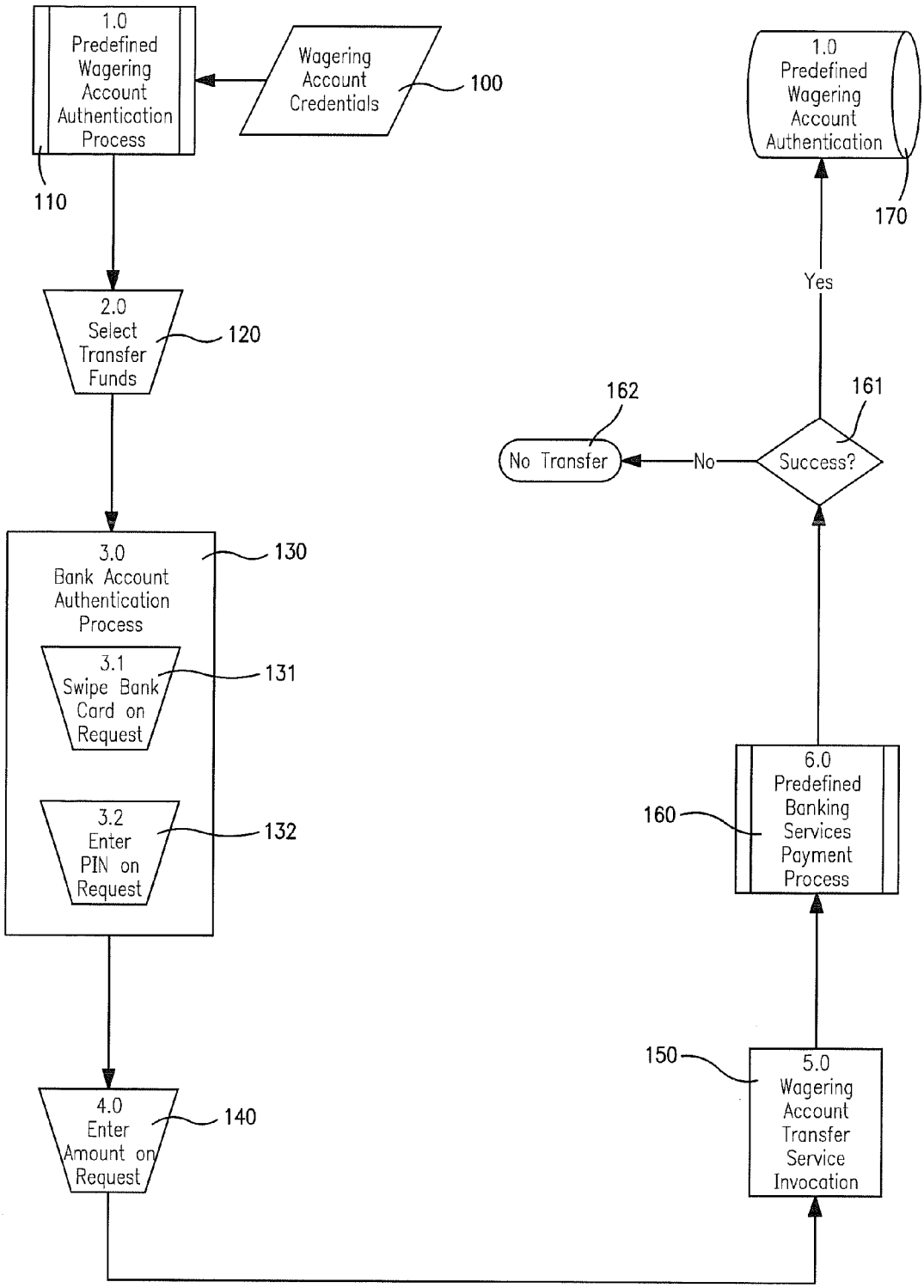
FIG. 1 provides a flow-chart illustration of an example of a transfer of funds using a bank card at a terminal according to an exemplary embodiment and method of the present invention.

Objects and advantages of the invention will be set forth in the following description, or may be apparent from the description, or may be learned through practice of the invention. The figures illustrate exemplary embodiments and methods that may be used to practice the present invention. Using the teachings disclosed herein, it should be understood that the present invention is not limited to the exemplary embodiments and methods of the figures and others may be utilized within the scope of the present invention.

A. Definitions

As used herein, the following terms are defined generally as follows:

Bank Account—an account established by a User with a bank from which the User may draw funds or replenish funds. The account may be accessed using e.g., a Bank Card or other means.

Wagering Account—an account established by a User with a Gaining Service Provider from which the User may draw funds to use the Gaming Service Provider's gaming services, such as pari-mutuel wagering. The account may be funded by cash, check, Bank Card or by the Gaming Service Provider (such as when the User wins a game). There may be many flavors of accounts ranging from permanent accounts to temporary accounts to anonymous accounts. The details of these accounts are predefined by the Gaming Service Provider.

Bank—the legal entity that manages a User's funds.

Bank Card—a card used to access a bank account. The card may be a debit card, ATM card, credit card, ACH (Automated Clearing House used for Electronic Checks), EDI (Canadian version of ACH) or Wire. The technology used to store information on the card may be e.g., magnetic stripe, electronic chip, optically readable markings, RFID, smart card, or combinations thereof.

Gaming Service Provider—a company that offers games of chance either directly or indirectly in which a User may participate. The Gaming Service Provider provides the necessary resources (whether software, hardware, network, etc.) for the Host in Charge system(s) as required.

Host(s) in Charge or HIC—a machine or cluster of machines upon which gaming services are provided by the Gaming Service Provider. The HIC can include a Wagering Module (e.g., tote processors) and a Banking Module, for facilitating banking transactions and communicating with banking systems.

Payment Processor Company or PPC—a third party company that acts as an intermediary between merchants and banks, generally providing access to numerous bank networks via a single entity.

PCT—Payment Card Industry data security standard. Certified mechanisms and processes are PCT compliant.

PIN—a User's Personal Identification Number. Essentially a password associated with a Bank Card.

PKI—Public Key Encryption.

Player/Patron/Wagerer—a patron making wagers or playing whatever game or games are provided by the Gaming Service Provider. The Patron may also be a User of a Bank Card.

Client Software—the component of a software application that resides on the Terminal. The Client Software will invoke services provided by the Server Software component. The Client Software is responsible for handling the presentation of the user interface to the User.

Server Software—the component of the software that resides on the HIC and usually resides in a centralized server location such as a datacenter. Many instances of the Server Software may be running simultaneously on multiple machines to satisfy the volume of requests from Client Software. One instance of Server Software may handle requests from many Terminals and any instance of Server Software may handle requests for any Terminal (i.e. a single Terminal is not bound by a single connection to a single machine). The Server Software is responsible for handling the business rules and database connectivity for the application.

Swipe—an action performed by a User where the User will swipe or insert a magnetic bank card, optically scan a scannable bank card, wave an RFID bank card, insert a smart card Bank Card, or otherwise allow for a Bank Card to be read and/or identified.

Terminal—a device that interfaces with the User and contains a pin pad such e.g., and embedded pin pad. The device also communicates with the HIC.

User—the owner and user of a Bank Card.

Virtual Pinpad—a pinpad presented on a Terminal screen and may be accessed using a pointing device (such as a mouse) or a touch screen. In embodiments, the virtual pinpad is not associated with the same level of security as a hardware pinpad and therefore is not suitable for use on most banking networks.

B. Exemplary Systems and Terminals

Described herein are exemplary improved wagering terminals and methods that allow for various means of funding a wagering account of the user/player/patron from which wagers can be made and maintained by a computer-based wagering accounting and maintenance system, such as a totalisator or other properly configured computer system. Though the invention will be described in connection with a BETJET™ terminal and in connection with parimutuel wagering, the invention is not so limited. Rather, the present description applies equally to other terminals and to funding of accounts for wagering on other events, such as lottery drawings, nonparimutuel sports wagers, casino games and the like.

Accordingly, the inventive aspects of the improved wagering terminal are described herein, not by way of limitation but by way of illustration, in connection with Scientific Games BETJET™ terminal. This terminal is constructed in modules around a basic centerpiece—the BETJET™ flip or a screen display. Modules can be added or removed to create a terminal that fits the requirements for a particular operator or application. A color touch screen is provided along with a display on the patron side of the terminal for providing information, announcements, and advertisements. The terminal can be used to provide complete account wagering with ticket-in/ticket-out functionality and cash acceptance. A full array of readers can be provided with the terminal including e.g., magnetic strip, bar code, smart card, cards with chips or other electronic devices, and biometric. When operated in a teller mode, bet entry can be provided through touch screens, keyboard modules, or both. The terminal can also be used to support wireless technology (e.g., Bluetooth®), "Chip and PIN" payments, and biometrics. Various configurations of the terminal using combinations of these features may be provided.

FIG. 1 provides a flow-chart illustration of an example of a transfer of funds using a bank card and terminal according to an exemplary aspect of the present invention. Step 110 provides an optional authentication step for a predefined wagering account based on the provision of wagering account credentials 100. For example, some account classes may require authentication (such as permanent accounts) whereas other account classes (such as cash terminals) may not. Steps 100 and 105 are a predefined process that is determined by the gaming service provider.

In step 120, the user navigates to a funds management screen on the terminal via the terminal interface and selects an option to transfer funds from a bank account to a wagering account. Some jurisdictions will allow only a subset of the possible types of bank cards. Accordingly, only the legal fund types allowed for the jurisdiction controlling the terminal will be available as options from which the user may select.

Continuing with FIG. 1, step 130 represents the process for acquiring credentials necessary to authenticate a user's bank card. More specifically, in step 131 the terminal screen requests the user to swipe or insert a magnetic bank card, optically scan a scannable bank card, wave an RFID bank card, insert a smart card bank card, or otherwise allow for the reading/identification of the user's bank card. As previously stated, the term "swipe" is used generically throughout to mean any one of the above methods of feeding bank card information to the system.

In step 132, the terminal screen requests the User to enter a PIN on the PCI compliant and PKI enabled pin pad. The pin pad is provisioned with appropriate PKI certificates by the PPC or Bank. The pin pad produces an encrypted representation of the user's PIN that can only be decrypted by the PPC or Bank. The level of encryption is usually the maximum number of bits of encryption that can be handled by the PPC/Bank or less if regulations restrict the number of bits allowed by the jurisdiction in which the terminal operates.

In step 140 the terminal screen requests the user to enter the amount of money to transfer. Next, in step 150, a software service is invoked on the HIC responsible for processing banking account transfers between the bank account and the wagering account. The encrypted PIN is received by the HIC from the Terminal. The HIC then sends the bank account information, the amount requested, the encrypted PIN, and other data to the PPC or bank via a secure network connection. This service or another asynchronous service will process the returned disposition of the request.

Step 160 represents the process the wagering account transfer service invokes by sending the information specified above to the PPC or bank. The PPC or bank generally provides a PCI compliant service. The interface to this service may be through any mechanism such as a web service invocation, function call from a library, a method invocation in a Java package, or any other method as specified by the PPC or bank. As indicated by 161 and 162, this process will return the disposition of the request back to the requesting HIC either approving the request or denying the request. The details of this service will vary from PPC to PPC and bank to bank. Finally, as represented by step 170 in FIG. 1, if the returned disposition is approved, a process on the HIC increases the amount of money in the user's wagering account by the requested amount.

As previously referenced, an exemplary terminal, such as the BETJET™ terminal, can be used for process described above with regard to FIG. 1. Such terminal has some or all of the following features and characteristics:

User friendly, self-service graphical interfaces
Use of open platforms and standards
Use of proven components
Use of financial industry standard XA architecture for transactional integrity
Use of serial or IP communications
Interactive wagering applications
Standard interface across all devices and versions to promote consistent feel and familiarity
User interface provides ability to add new services without sacrificing time-to-market
Web-based services, such as help and tutorials
Extensive Help system
Provision for use of one account across multiple venues
Secure banking interface at POS
The following certifications and approvals:
1. CSA 22.2 #950
2. UL 1950 and CE
3. EMI: ICES003; FCC part 15
4. ESD: IEC 801-2 class 3; EN50082-1
5. PCI Compliance It is also desirable that platforms other than the terminal have access to the same wagering account, such as by Internet wagering (if legal), telephone wagering, and OTB. Integrating the banking account with the wagering account further simplifies account administration and management for both OTB sites, as well as the end users, i.e., the account holder.

A variety of methods can be used to make transactions secure, including e.g.:

Third Party Data Classification
Global Data Encryption
Digital Signatures
User Authentication—Active Directory
Role-based User Permissions
Independent Monitoring System
Alert Software
C. Users and Use
1. Types of Players/Users The following classes of players/users are contemplated for the systems and methods of the present invention:

(a) Permanent Account Holder—a patron with a permanent account that may be used day-to-day, replenished at will, and used wherever legal for wagering/gaming activity. The funds are maintained by account software services provided by the HIC and stored in a database also controlled by the HIC.

(b) Temporary Account Holder—a temporary patron, such as a patron that establishes a temporary account with a terminal. This is usually an anonymous, cash or bank card funded, account. An account identity slip is produced that may be used to access the account's funds from different terminals. The lifetime of a temporary account is controlled by time (usually 1 session for pari-mutuel events) or until the patron closes the account by requesting a voucher for any remaining funds associated with the temporary account, whichever comes first. If a temporary account has an IRS event (usually a winning wager that pays out an amount over some amount established by the IRS or other governing authority) the temporary account will remain open, for the purpose of IRS reporting only, until the IRS reporting process has concluded. The funds are maintained by account software services provided by the HIC and stored in a database also controlled by the HIC.

(c) Pre-paid Card Holder—a patron that has added funds to a pre-paid card. A pre-paid or stored value card is another form of temporary account. The stored value card allows the patron to use the same card at different terminals accepting the card. The lifetime of a pre-paid or stored value card may also be controlled by time. An incentive of using a pre-paid card (paperless) over a terminal (paper-based) temporary account might be to allow expiration times to be on the order of months or years as opposed to hours or a single session. The same IRS restrictions for account closure described with temporary account holders apply to this type of account. The funds are maintained by account software services provided by the HIC and stored in a database also controlled by the HIC.

(d) Voucher Holder—a patron that holds a monetary voucher for a specified value.

(e) Winning Ticket Holder—a patron with a winning ticket that can be redeemed for cash value.

2. Example of Use where Player has Existing Wagering Account

In one exemplary aspect the present invention, a method is provided by a player to use an existing wagering account. For example, at the wagering terminal, the player swipes an account or player rewards card and enters a PIN number or other security identification credential to authenticate and get access to his account. The PIN is entered in via a Virtual Pinpad, such as via a touch screen, keyboard, mouse, light pen, or other interface device. The player's wagering account is maintained by the HIC and not on the card. If authenticated, access is then granted to the account for wagering and other functions using the terminal.

The player can then decide to add to his or her balance from a bank account using e.g., his bank card, such as ATM card, debit card, or credit card associated with a credit account. From the user interface, the player selects the account balance replenish option and then swipes his bank card. If allowable, it is also possible to configure the wagering terminal to perform ACH transfers based on a routing number and bank account number, captured from a bank card such as a debit card or entered via a keyboard or virtual pinpad, which are communicated to the banking system via a communication link from the wagering terminal.

The player is then connected to his banking system and is prompted for his PIN. Alternatively, the PIN is requested to be entered by the terminal and then sent to the banking system with the initial communication to the banking system.

Figure 2:
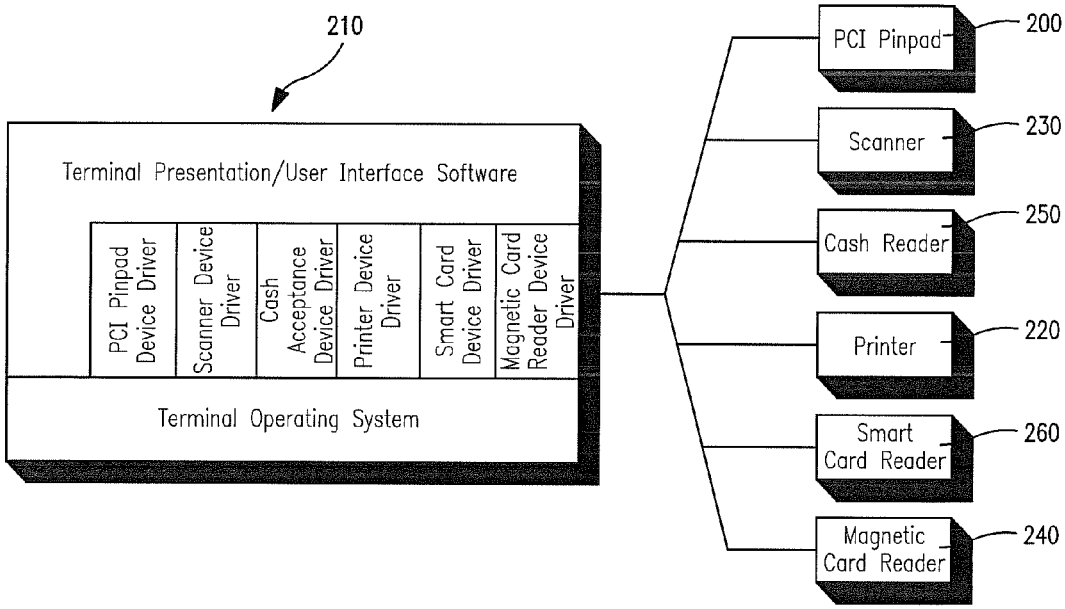
FIG. 2 illustrates exemplary architecture for a representative terminal as may be used in exemplary embodiments of the present invention.
Figure 3:
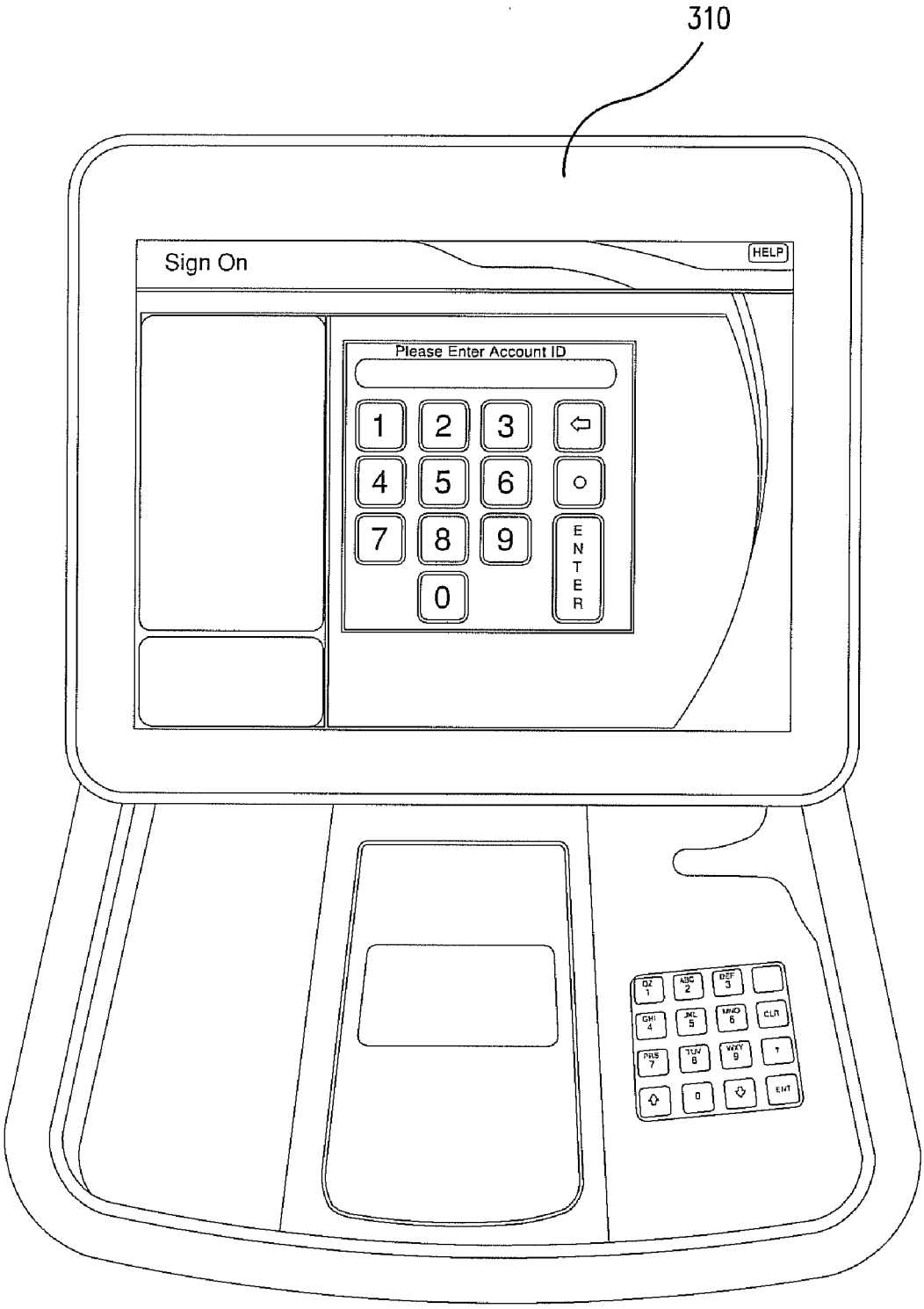
FIG. 3 depicts an exemplary embodiment of a terminal of the present invention.
Figure 4:
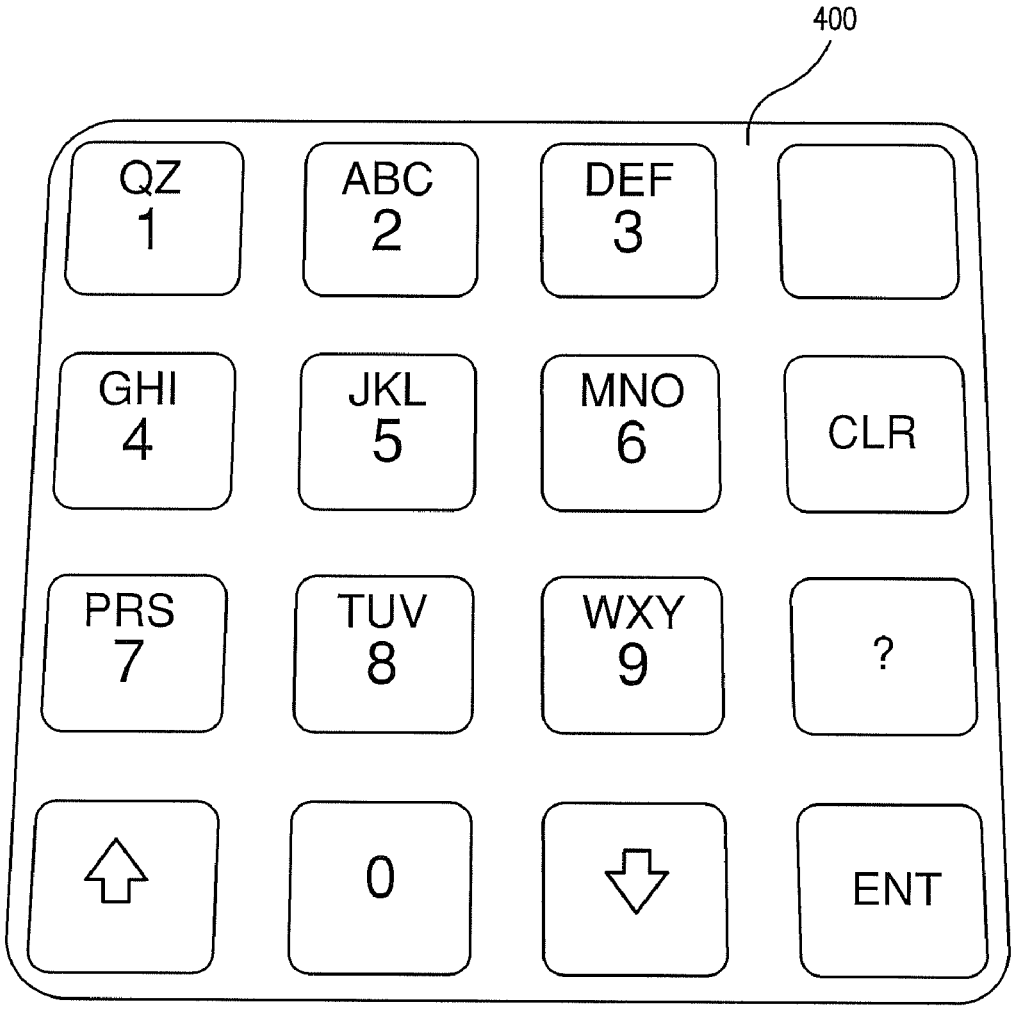
FIG. 4 depicts an enlarged picture of an exemplary banking pin pad.

FIG. 2 illustrates schematically the software architecture on an exemplary terminal 210 that shows how the secure pin pad and other devices use device drivers to interface between the device and the rest of the software. Preferably, bank account PINs are always entered using the secure PCI compliant PIN pad hardware device connected or integrated with the terminal. In one embodiment, the player enters his PIN using the Integrated Banking Pin Pad 200 that is connected to or integrated with the terminal 210. A picture of an exemplary terminal 310 is shown in FIG. 3, and an enlarged picture of an exemplary Integrated Banking Pin Pad 400 is shown in FIG. 4.

The player is eventually prompted to enter the amount to be transferred from his account to his betting account. This may be entered, for example, using the user interface of the terminal 210. The player then awaits verification of the requested transfer, typically a few seconds. When approved by the banking system, the funds are updated in the wagering account and are immediately available for use. Each banking system/entity has its own process for approving and disapproving such transfer requests, the details of which are known in the art and do not form a part of the present invention. The wagering account balance is updated on the screen in real time, and the player can continue to wager from his wagering account balance. The player can also add to his existing account balance using vouchers, pre-paid cards, cash and winning tickets described below.

3. Example where Player does not have an Existing Wagering Account

Assuming the player does not already have a Wagering Account, the player can wager in a number of ways using the wagering terminal:

(a) Establish a Temporary Account

Temporary accounts are established at the wagering terminal. When a player establishes a temporary account, the player enters a PIN that will be used for the account using the pinpad (e.g., a virtual pinpad) and the wagering terminal prints an account identity slip using e.g., printer 220 as illustrated in FIG. 2. This account identity slip can be scanned by wagering terminals and used by the wagerer like the account card described above. Access to the account is granted by providing the account PIN.

Alternatively, the player can swipe a blank pre-paid account card (for example the SGI ClearBet Card). This card has a unique account number on it which is used to establish the temporary account. The player then selects and enters a PIN to be associated with the account using e.g. the virtual pinpad.

This account can be funded using the wagering terminal in a number of ways, including: (a) funded using a bank card account as described above; (b) funded from a voucher scanned by the wagering terminal; (c) funded from a winning betting slip; or (d) funded with cash.

When the player is done wagering with the temporary account, the temporary account may be closed out by (a) printing a voucher; or (b) sending the funds to an existing credit or bank account using the wagering terminal and secure PIN pad.

(b) Wagering without a Temporary Account

Alternatively, the player can use the wagering system without establishing a temporary account. The wagerer can use a bank card to load funds from a bank or credit account (as described above) directly to the terminal for wagering. Funds can also be loaded from a voucher, pre-paid card, winning ticket or cash. Once wagering is completed, the remaining funds can be (a) printed as a voucher or (b) transferred to a bank account, as described above. Optionally, the player can upgrade to a temporary account, meaning a blank (or valueless) pre-paid card is swiped, a PIN is selected and then funds are loaded onto the card.

D. Back Office Settlement

Typically, the Gaming Service Provider will have a contractual or other relationship with the backend banks or processing system providers that will govern the terms of the settlement of funds transferred from and to the gaming service provider's wagering system. As part of this settlement, as with ATM machines, the gaming service provider can, if accepted by the user, receive a fee (e.g., $2) from, for example, each fund withdrawal by the user.

E. Exemplary Highlights/Advantages of Exemplary Embodiments of the Invention

By way of example, some of the advantages of various exemplary embodiments and methods according to the invention may include one or more of the following:

Integration of a banking industry certified PIN pad with a wagering device.

Major back-end transaction processing systems such as Visa, MasterCard, UPS and many others can be integrated with the system, allowing gaining service providers to integrate with and migrate to new technology innovations as they occur.

Implementation of banking and financial trading system standard XA transactional protocol.

Transaction architecture for all wagering terminal-to-system transactions.

Banking interface provides banking network integration to allow patrons to directly deposit to their wagering accounts using a bank card.

VoiceXML implementation of an IVR wagering and results system underpinned by the newly enhanced Trackplay database and application.

High speed 3rd party integrations such as OperaGlass Networks. Ability to integrate wagering product into customer-facing race track facilities such as food & beverage and on-track video sources. Using the integrated PCI compliant pin pad, the Patron can use the patron's bank card to purchase food and beverages, T-shirts, racing programs, etc. as well as fund the patron's account. Appropriate software modules can be provided to the terminal and/or HIC for facilitating purchasing of these products.

Central Account Wagering to provide wagering account access to subscribers of suitably authorized services.

F. Additional Components of an Exemplary Wagering Terminal

By way of example, the components of an exemplary wagering terminal can include a CPU, such as a P4 PC on an ETX format frame. The main operator interface is a fifteen inch LCD with touch screen. When the terminal is in self-service mode, this same screen becomes the main patron (i.e., wagerer) interface.

Returning to FIG. 2, there are two main peripherals that deal with reading tickets/bet slips and issuing tickets and receipts. The reading method may be via a 200 DPI document scanner 230, or higher resolution scanner if added security is required. This scanner 230 reads the document and sends a BMP to the CPU for processing. Once processed, a receipt or ticket can be printed on the 200 dpi thermal printer 220.

In exemplary embodiments, with respect to banking services, two main hardware modules are used. These are the magnetic card reader 240 and the secure PIN pad such as PCI pinpad 200. Each of these devices is connected to communicate with the CPU through a custom port expansion board or engine. Both are simple serial port connections. The secure pin pad 200 is a commercially available device that is PCI compliant, and thus access to the internal hardware and the encoding keyword are generally not available. The basic operation of the PIN pad 200 is to encode a received pin number and pass along the encrypted number to the application software of the HIC for further communication to the financial system for processing.

In certain exemplary embodiments, the pin pad 200 may be the SMARTPIN™ PIN pad, model IDPA-702000, available from International Technologies & Systems Corporation of Cypress, Calif. By way further example, the pin pad 200 is a PIN entry device that can be used for both outdoor and indoor unattended point of sale operations requiring entry of a PIN. Both online and offline verification options may be included. A backlight may be provided for the entry keys. Visual indication of the keys entered as well as audio feedback may also be provided. PIN entry may be encrypted and securely transmitted over an RS232 or USB 2.0 communication interface. For example, DES and TDES encryption algorithms may be provided.

Figure 5:
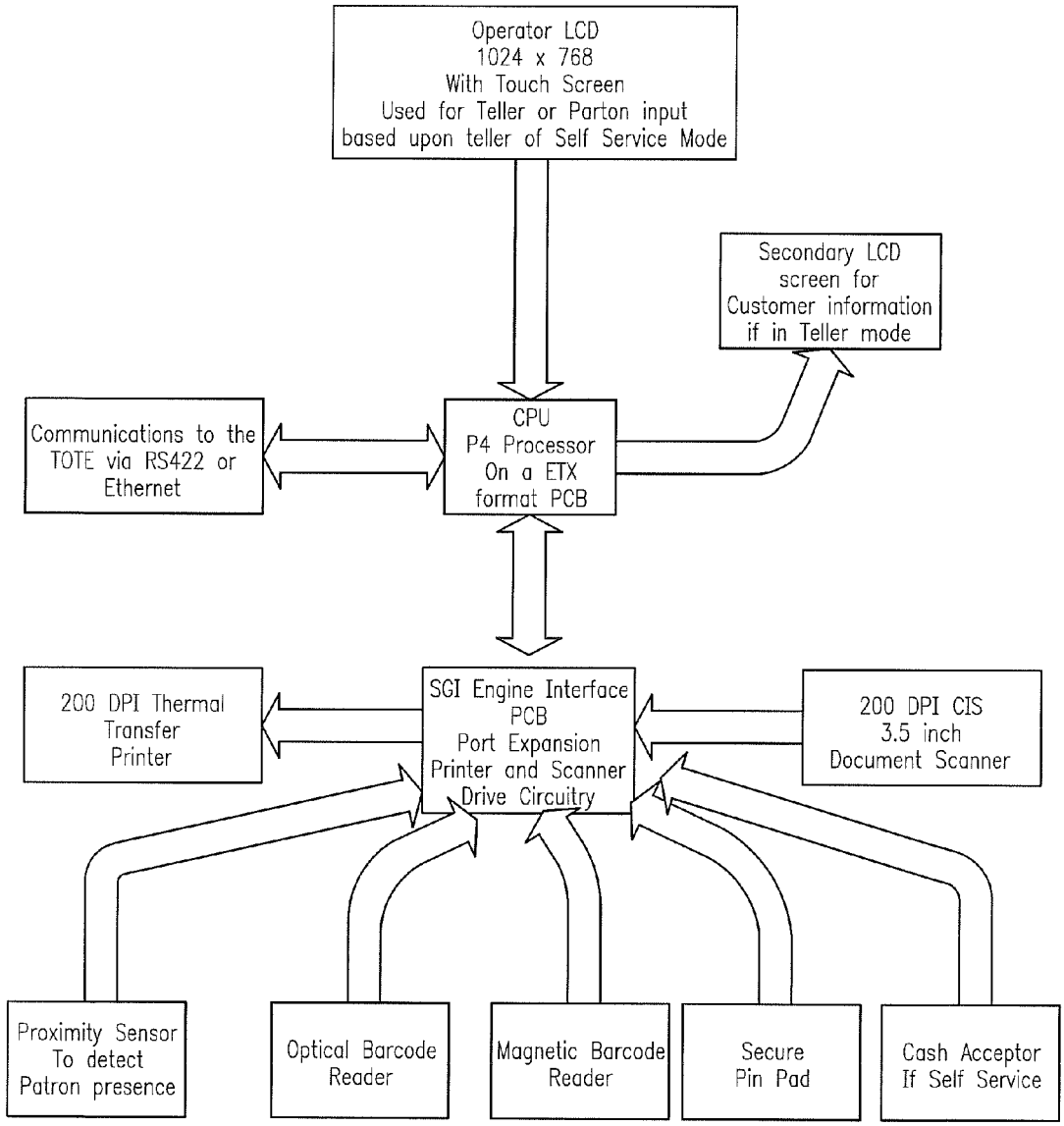
FIG. 5 provides a highly schematic block diagram of the architecture of an exemplary terminal of the present invention.

A highly schematic block diagram of the architecture of an exemplary terminal is shown in FIG. 5. Components readily familiar to those in the art, such as various busses, memory modules, caches, BIOS, etc. which form common components of CPU controlled devices are not shown so as to not obscure the present disclosure.

Some specific components of an exemplary wagering terminal are now further described below:

1. Bet Ticket/Voucher Slip Reader

The ticket reader reads wagering tickets, specifically a bar code or other indicia on the ticket. The ticket reader provides the information to the terminal 210, which then checks with the backend accounting system (e.g., totalisator) to determine if the ticket has value. If the ticket is a winning ticket and has value, the value can be added to the terminal wagering account or the user's permanent or temporary account (if the user has such account).

2. Printer

The printer 220 is used to print bet/game slips (if desired) after a user has placed a wager. The printer can also be used to print vouchers, which represent currency and can be used to transfer funds or cashed, and temporary account slips.

3. Keyboard and/or Keypad

The BetJet Flip terminal is equipped with a teller keyboard.

The Flip, SL and the AB terminals are equipped with a pre-certified secured PIN key pad (discussed below) for secure banking interface transactions as described herein.

The patron-facing secure PIN pad is available with the Flip, SL and AB models and is required by banks to facilitate certified banking transactions. The device is banking network certified.

G. Communications

Communication to and from the wagering terminal with the backend banking system can be implemented as either serial or IP, as the terminal may be equipped with both types of communication ports. Standard features of either the teller or the self service application can be provided through serial connections which are common in most legacy systems. The communications infrastructure to the terminal can be upgraded to Ethernet, where a operator or OTB wishes to extend additional features that require IP communications (now or at some future date). Both communications types can be implemented with the same terminal. Wireless communication between the host computer and the terminal is also available. Wireless 802.11 a/b/g Access Points located throughout the facility can communicate with terminals located in public areas where other forms of hard wired circuits are not available. Peripheral devices may also be connected via Bluetooth™.

H. Other Peripheral Equipment Interface

Other peripheral equipment interface elements that may be provided in various exemplary embodiments of the present invention are as follows:

Serial Ports Up to 8

Ethernet 1 Port (10/100)

USB (Universal Serial Bus) Up to 8

Audio: 2 Audio Out and 1 Audio In

Keyboard/Key Pad 1 PS2 protocol

Mouse (Disabled by OS) 1, PS2 protocol

Magnetic and smart card reader on the BetJet Flip™, SL, and AB terminals. As a practical matter, the magnetic card reader can read all three tracks available on most cards. The smart card reader is able to process all major memory and microprocessor cards available on the market.

Coax connection port for receiving video feeds

I. Wagering Terminal Security Measures

The BetJet™terminals and other devices contain several layers of security to protect the software residing on them, sensitive data transmissions, and the system to which they are connected. Wagering device data are classified in accordance with good data security policies. Each individual data item is classified ranging from public to top secret, and encryption applied accordingly. BetJet™ devices also have an integrated banking-certified (PCI) PIN pad for secure banking interface. Information transmitted received via the PIN pad, i.e., the user's PIN, is encrypted and preferably not at all captured, monitored or analyzed by the system or wagering terminal; rather, the system services to merely pass the encrypted PIN to the banking system along with other information (e.g., transfer amount) received using the user interface of the terminal.

J. Video Services

The BetJet Flip™, BetJet SL™, and BetJet AB™ are all capable of providing video, video retrieval, Internet access and access to third party information providers (racing/past performance information, food and beverage ordering services, credit card deposit services, etc.). Although this functionality can be extended to all of these devices, it is preferred in a system that these specialized features only be enabled on devices operating at a "personal" level or by a small group of people in a private environment, as opposed to a multi-user device on main lines. This helps avoid situations where terminals in the public areas intended for high transaction volumes are monopolized by patrons performing non-wagering functions, ultimately causing frustration to others and potentially missed bets. These services may also be offered by terminals in public places that have been set aside and dedicated to provide specific functions such as player rewards, etc. The goal is to significantly reduce or eventually eliminate the need for the terminals to handle paper or cash. In, pursuit of this goal, the terminals help to promote account wagering, via either daily or permanent accounts, to become the norm for all patrons to place bets in the future. In order to create a truly paperless environment, the terminals provide debit/credit card services to transfer funds between bank and wagering accounts and provide full account wagering functionality. Understanding, however, that some patrons will want some form of receipt, the terminals provide that functionality unless and until patrons have fully accepted the idea of completely paperless/cashless wagering.

K. Security Audit

The code for operation of any system of the present invention can be secured by classification. For example, an audit can be conducted line-by-line of all such systems to classify each of the pieces of data the systems manage. The classifications can range from "public," meaning the information can safely be viewed by almost anyone (example: race results), to "top-secret," meaning access to this data is restricted to all but a few individuals, if any (example: credit card number). Once classified, any data not considered "public" can be encrypted both for storage and for transmission via SSL.

L. Control Over Access

With data classification rules in hand, the system can effectively manage who has access to the various classes of data through two related practices: User Authentication and Role-based User Permission.

1. User Authentication

A user identification and password management tool can be provided that authenticates all users when they first sign on to the system. All passwords can be stored as "one-way hash" meaning the password is encrypted such that a user can get from the password to the encrypted value of the password but not the reverse (i.e. the password can't be determined by "un-encrypting" the encryption).

2. Role-Based User Permission

A database can be provided that stores the role-based user permission parameters that dictate what each user can do and see, according to their role in the organization. The database can work in tandem with the data classifications to guide the user's entire journey through the system, customizing their data views based on what they have permission to access.

M. Exemplary Screen Shots and Illustrations of Examples of System Operation

Figure 6:
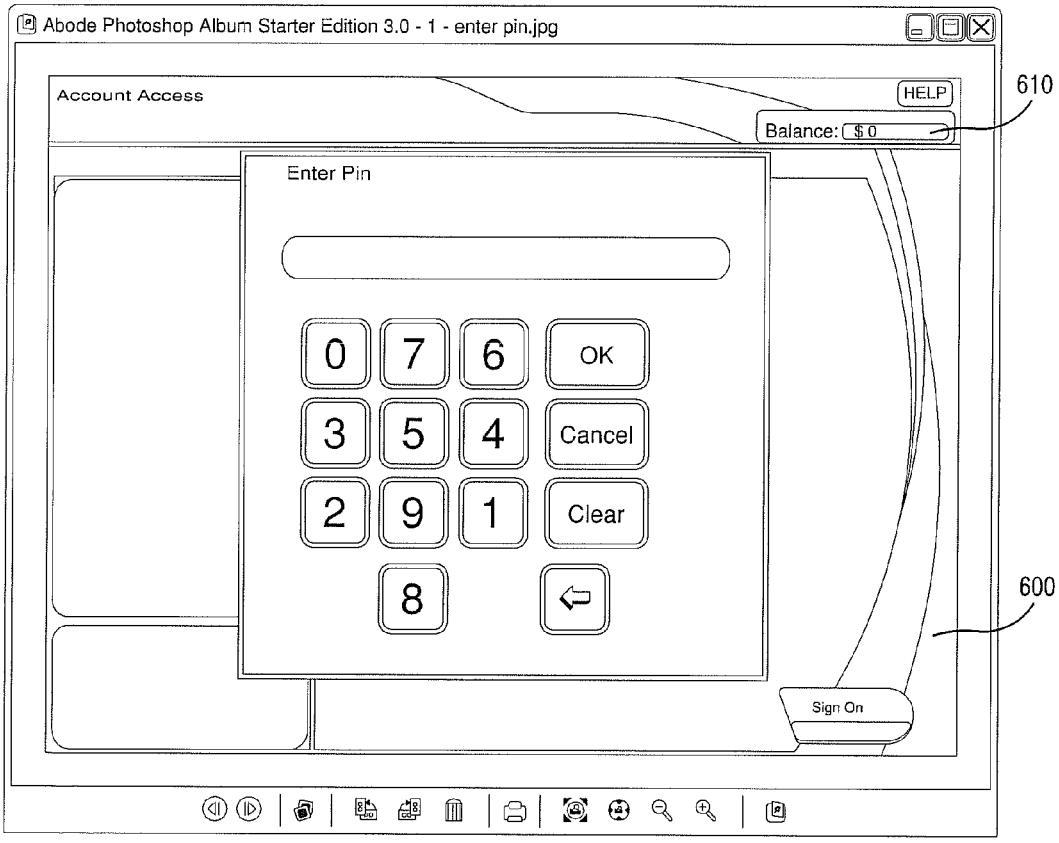
FIGS. 6-13 illustrate exemplary screen shots as may be provided by a terminal accordingly to exemplary embodiments and methods of the present invention.
Figure 7:
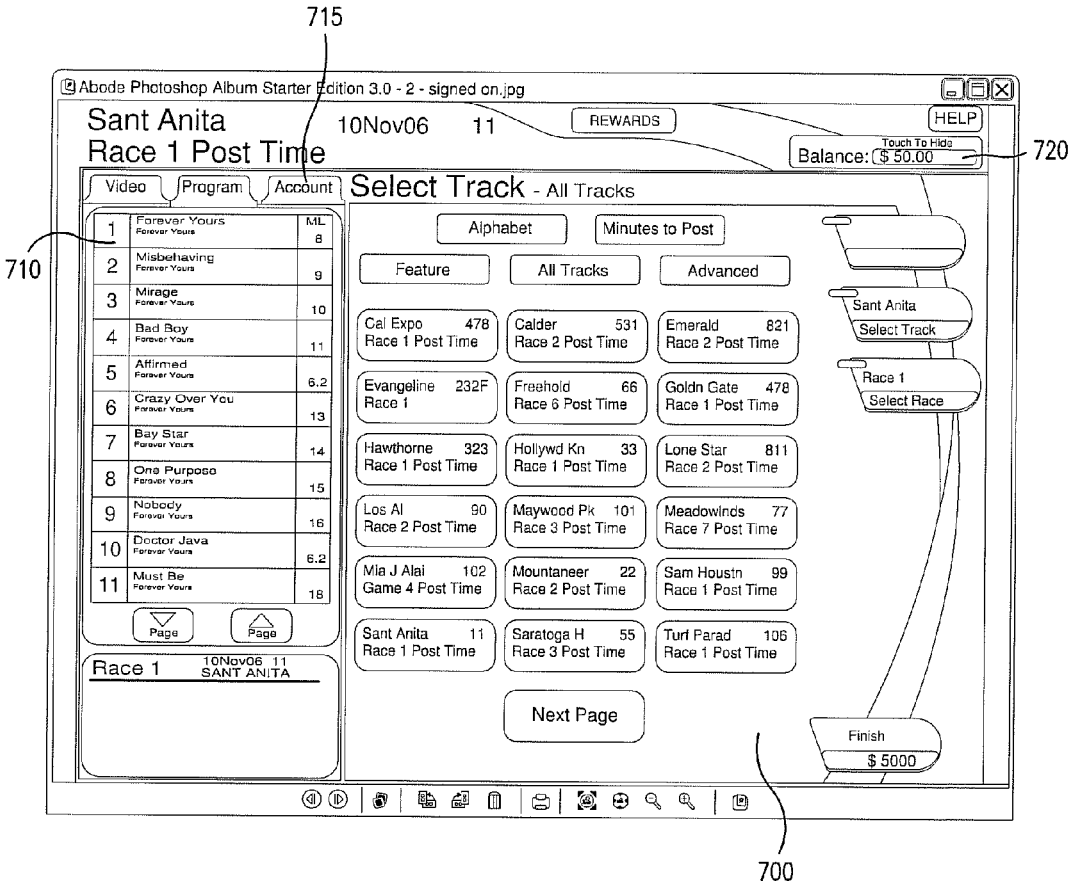

Several examples of screen shots from an exemplary system of the present invention will now be discussed. For example, FIG. 6 illustrates an exemplary screen shot 600 where a user is requested to enter his/her wagering account PIN to gain access to a wagering account. Next, FIG. 7 illustrates a screen shot 700 where the player has obtained access to his/her account and to the wagering interface for placing wagers. Various icons are provided whereby the player may undertake various selections such as selecting race information.

Figure 8:
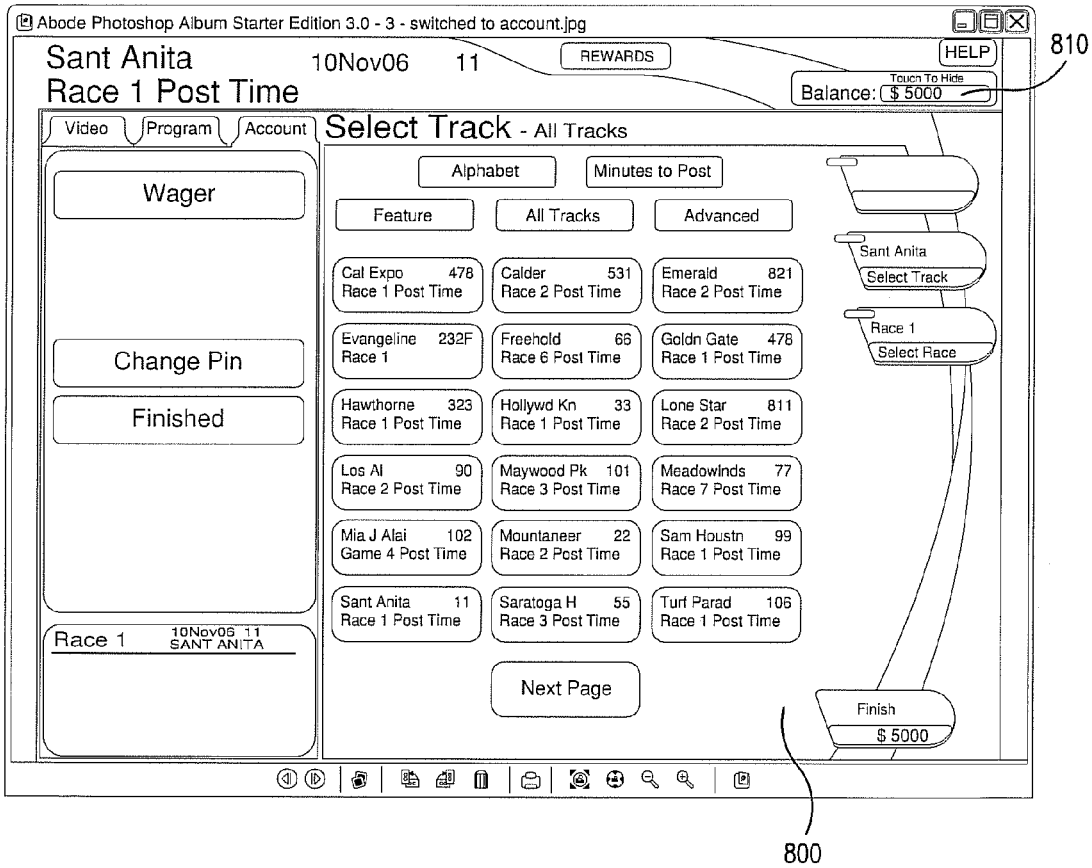
Figure 9:
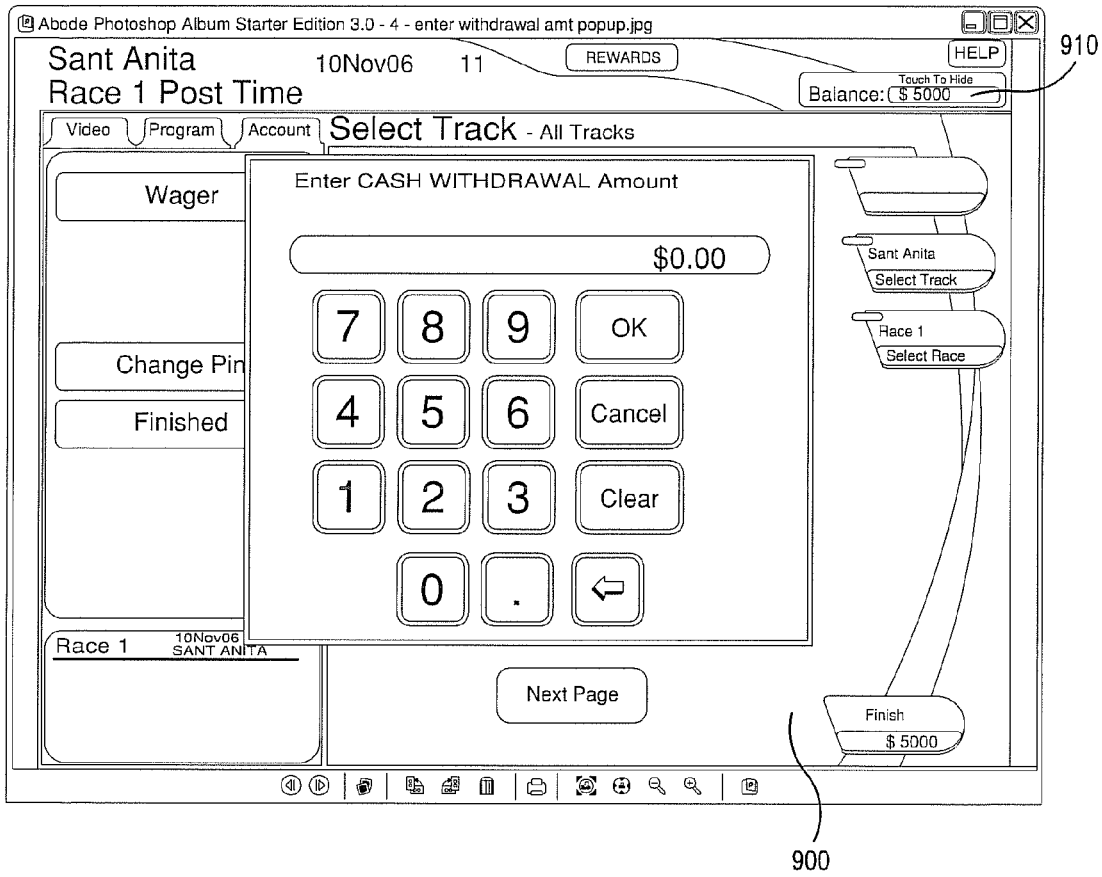

By way of example, assume a player strategizes his betting and feels like he needs to have more funds in his/her betting account and believes a $5,000 account balance is not sufficient for the bets he wants to place. The player is then allowed to initiate adding more funds by selecting the "Account" icon 715 to reveal a screen as illustrate by screen shot 800 in FIG. 8. The player/user is then prompted by any appropriate prompt, tab, icon, etc. to transfer funds. The terminal then prompts the user to enter the amount (any currency) of cash withdrawals from his banking account as illustrated in screen shot 900 of FIG. 9.

Figure 10:
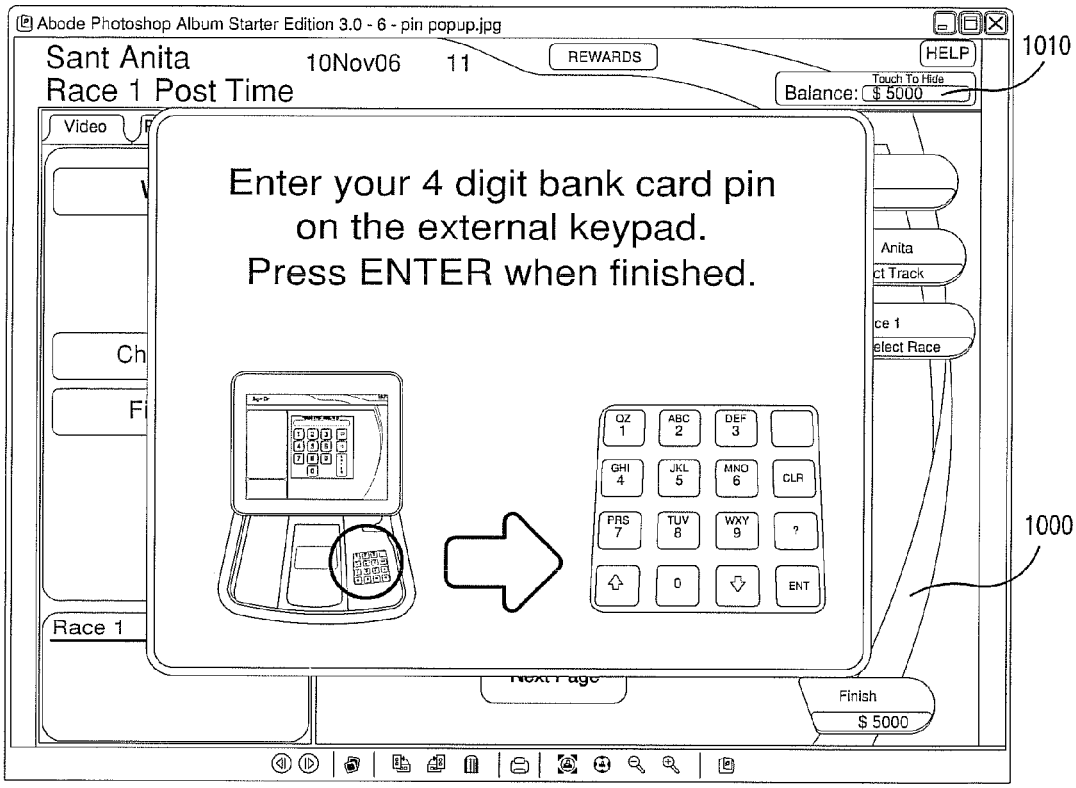
Figure 11:
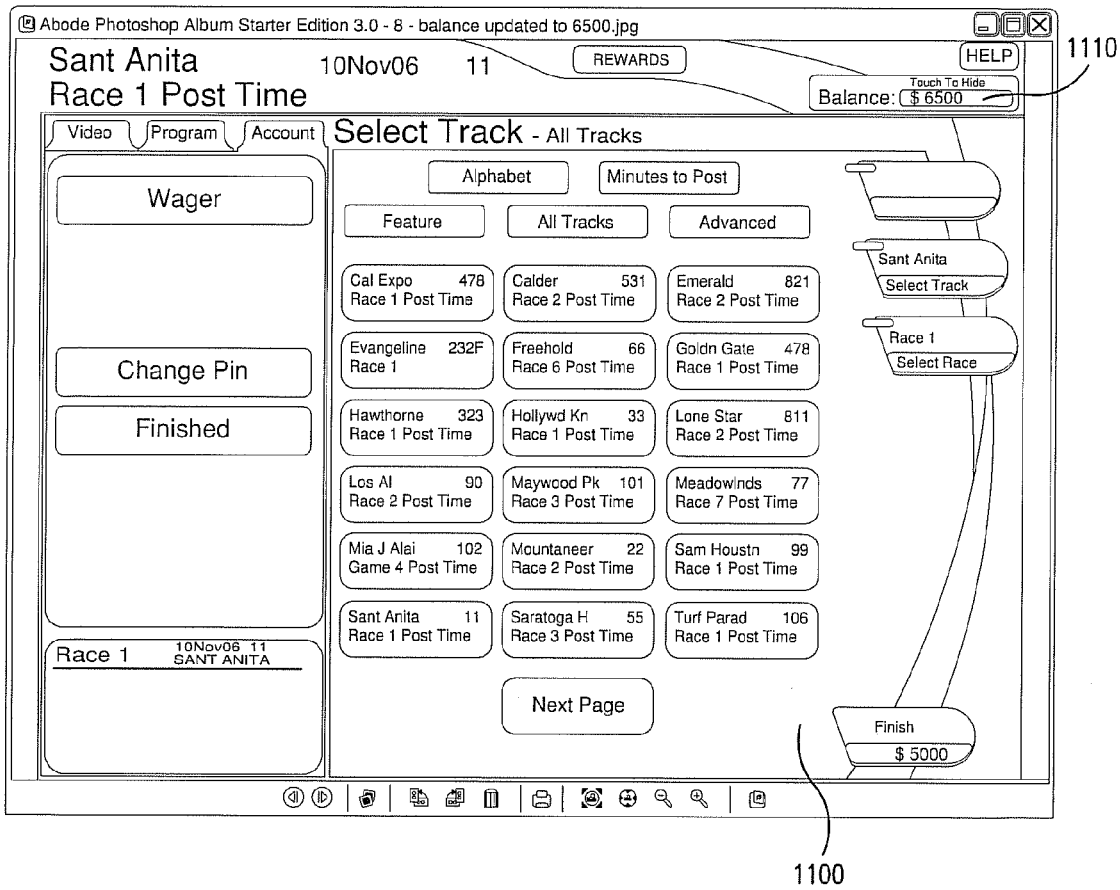
Figure 12:
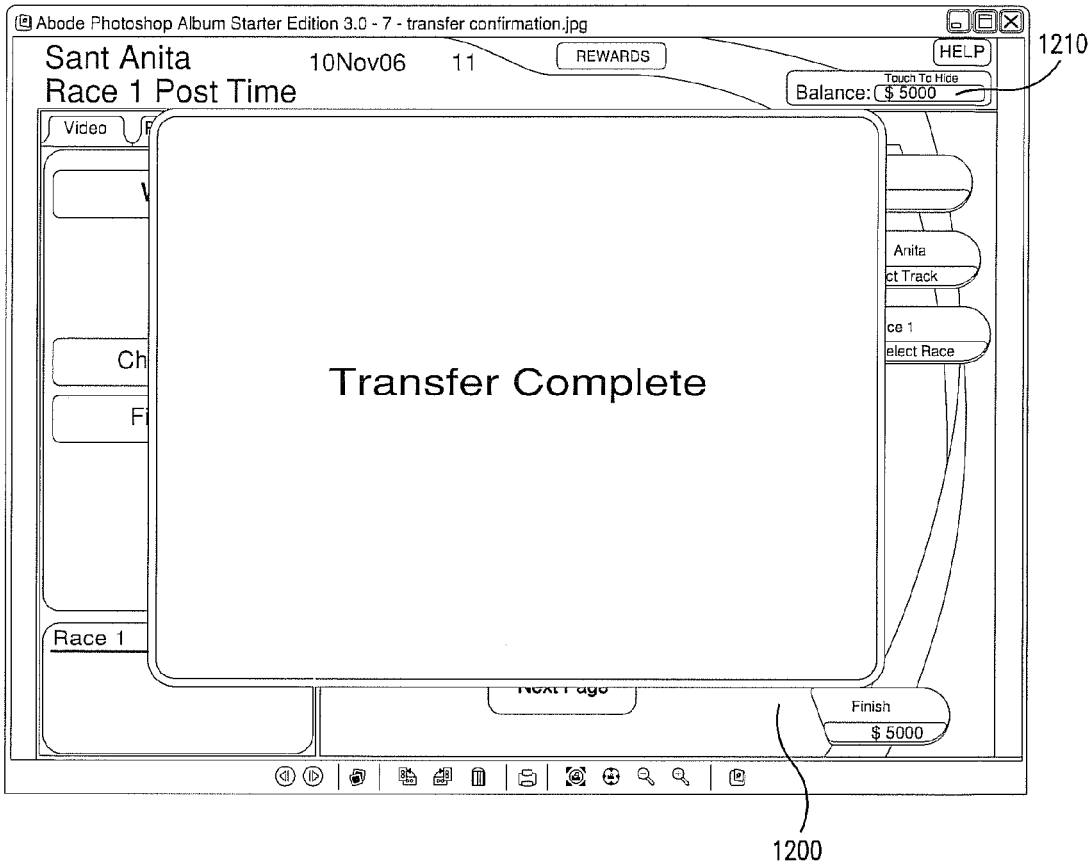
Figure 13:
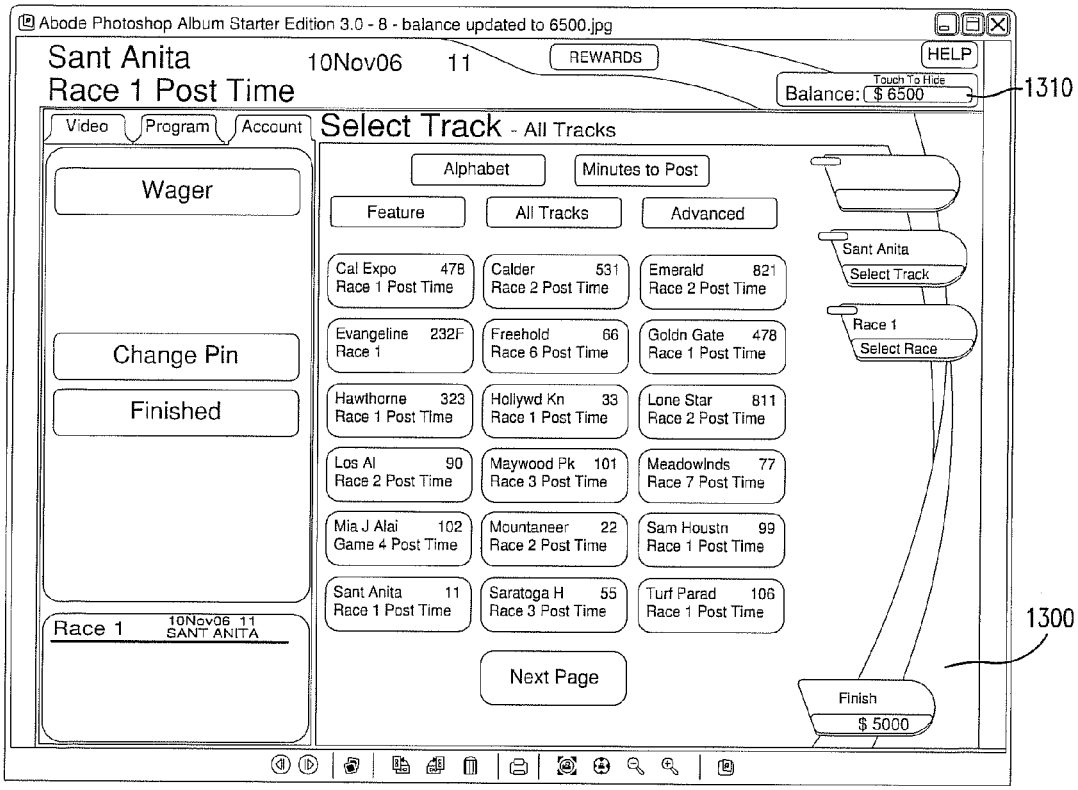

As shown in screen shot 1000 of FIG. 10, the player/user is then prompted to enter his e.g., four digit Bank Card PIN using the secure pin Pad integrated with the wagering terminal. The player enters the PIN using the Pin Pad and then presses "Enter" on the Pad. The player/user is then prompted for the fund transfer and the terminal confirms when the transfer is complete i.e., when the bank end processing and third party payment processor and bank processing are completed as shown in screen shot 1200 of FIG. 12. The player/user is then returned back to a screen 1300 for wagering as shown in FIGS. 11 and 13, where the new updated wagering amount of $6500 is reflected in the balance icon 1110 for the player's wagering account.

Figure 14:
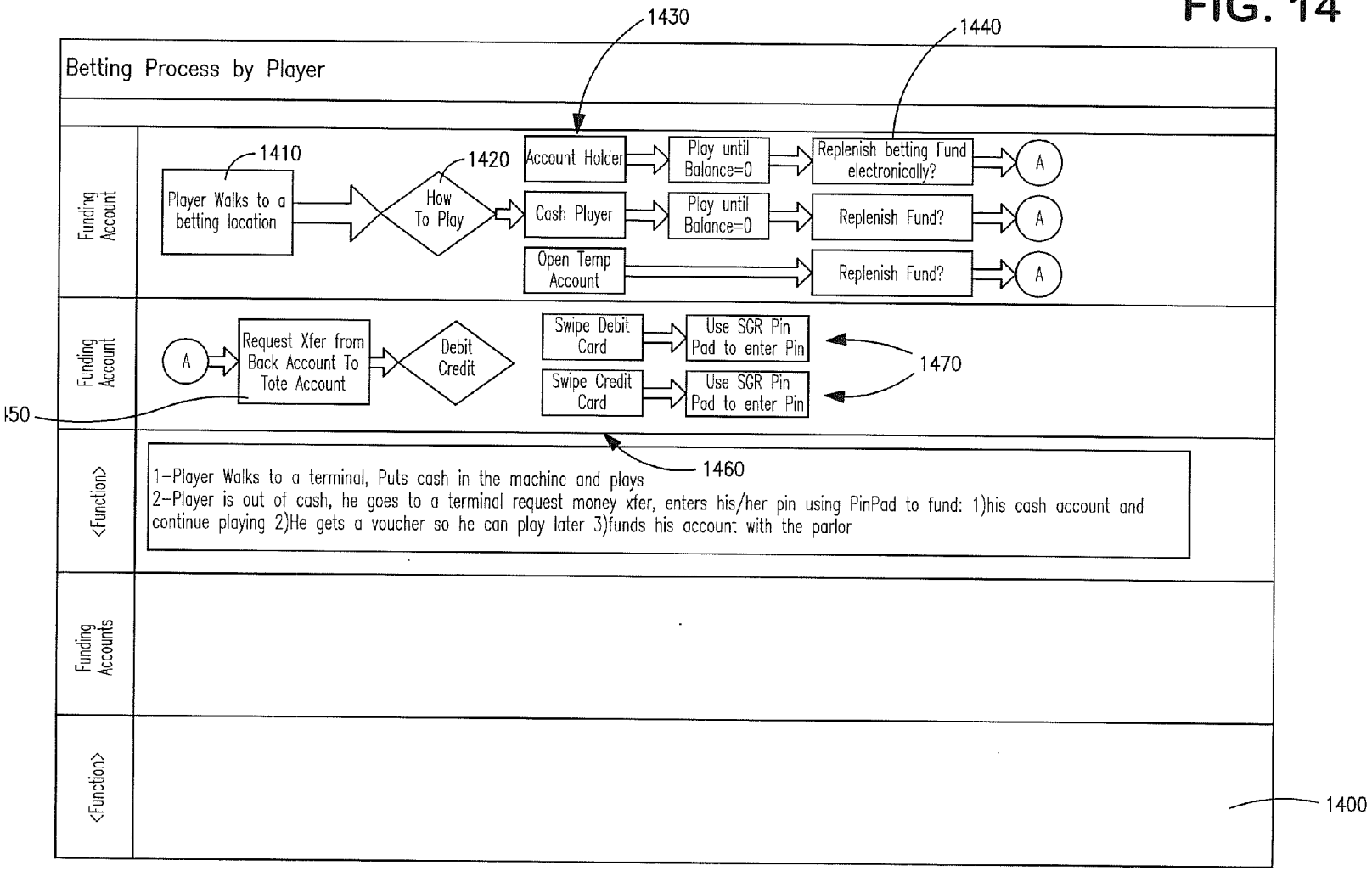
FIG. 14 illustrates various additional and exemplary operating scenarios for methods of the present invention.

The flow chart 1400 of FIG. 14 illustrates various additional and exemplary operating scenarios for the present invention. For example, beginning with step 1410, the player walks into a betting location. After determining how to play in step 1420, the player's next step 1430 is determined by whether the player is already an account holder, a cash player, or intends to open a temporary account. In each case, the player ultimately is prompted for funds as shown in step 1440. Accordingly, in step 1450 the player undertakes a request for transferring funds from his bank account using either a debit card or credit card in step 1460. In either case, the player is prompted to enter a PIN as shown in step 1470 for the transfer of funds.

The present invention can be embodied in the form of methods and apparatus for practicing those methods. Control and operation of above-described terminal and its functionality, and of backend systems, can be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. Whether stored in a storage medium, loaded into and/or executed by a machine, or transmitted over some transmission medium, such as over electrical wiring or cabling, through fiber optics, or via electromagnetic radiation, when the program code is loaded into and executed by a machine, such as a computer, the machine becomes an apparatus for practicing the invention. When implemented on a generalpurpose processor, the program code segments combine with the processor to provide a unique device that operates analogously to specific logic circuits.

N. System Description

Figure 15:
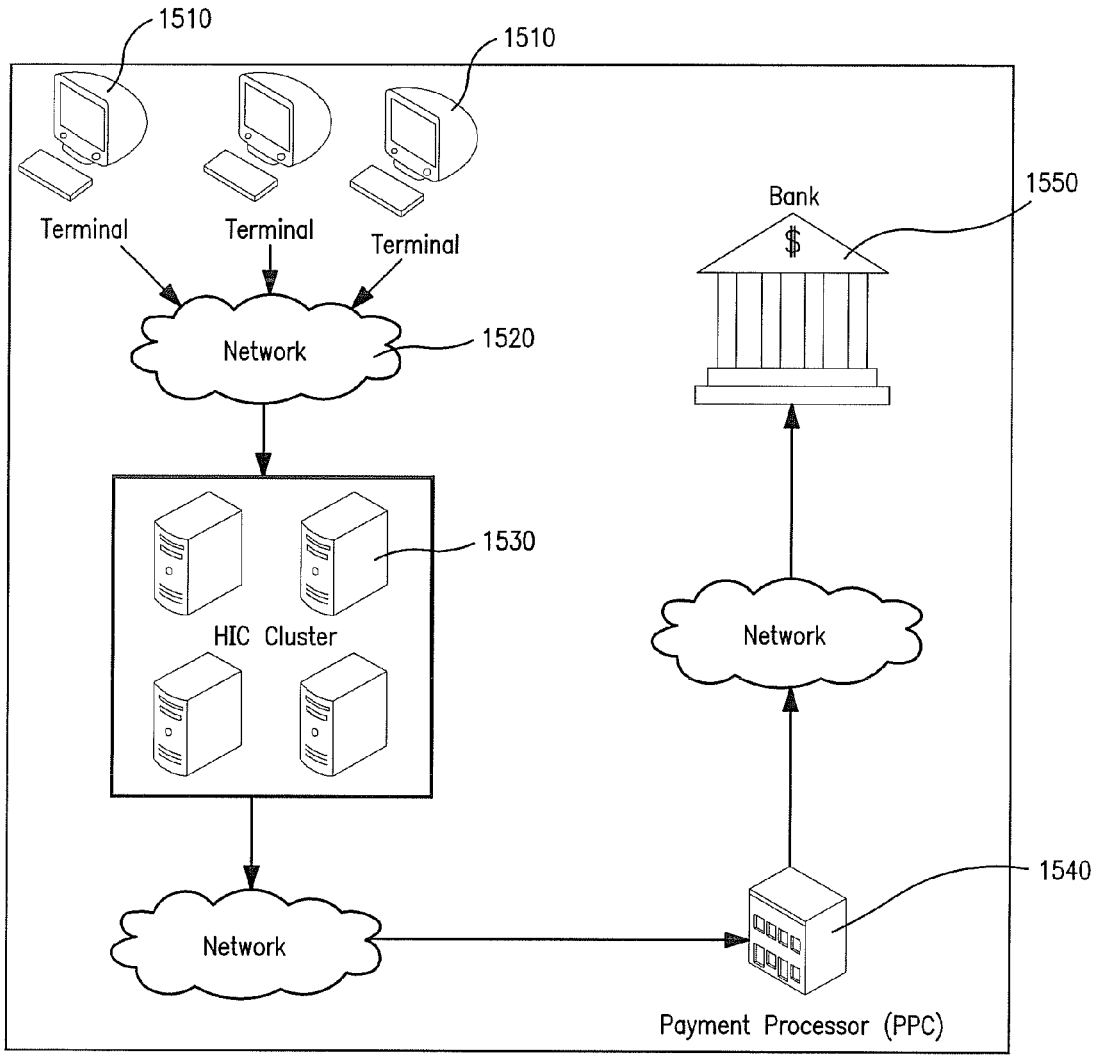
FIG. 15 illustrates an exemplary method of operation of the present invention.

FIG. 15 illustrates an exemplary system including one or more wagering terminals 1510 as described above. As shown, the wagering side components of the system include one or more wagering terminals 1510 as described above, a network 1520, one or more machines 1530 representing the HIC, and a series of hops on various networks comprising the banking network. The wagering terminal 1510 is as described above and includes features such as a touch screen, flip screen, magnetic stripe reader, optical reader, scanner, printer and secure PIN pad.

The wagering terminal may communicate directly with a HIC. More commonly, however, the wagering terminal is at a site remote from the HIC, such as a track or OTB. In these embodiments, the wagering terminal communicates with the HIC through a secure private communications network. The details of such communication networks, such as LANs, WANs, etc. are known per se to those of ordinary skill in the art and need not be repeated or detailed herein. One description of such networks and components can be found in U.S. Patent Application Publication No. 2005/0021492A1, entitled "On-Line Sales Analysis System and Method," the entirety of which is hereby incorporated by reference herein.

As those of ordinary skill in the art will also understand, wagering systems for parimutuel wagering uses wagering machines known as "totalisators" to generate wagering odds in real time based on the wagers placed on racing events at various racetracks and in this embodiment are a component of the HIC. Totalisators are available from companies such as Scientific Games Racing, LLC of Alpharetta, Ga. Totalisators may be located at a racetrack or "hubbed" together with totalisators for a set of racetracks at one of the racetracks or a centralized datacenter not associated with a racetrack and are networked together to communicate data between one another. Totalisators currently communicate between one another using a communication protocol known as the Intertote Track System Protocol (ITSP). The communication between totalisators allows totalisators to share pools, thereby allowing racing fans that interact with one totalisator to view odds and place wagers on races at other racetracks. Permanent and temporary wagering accounts are maintained at a toalisator associated with the track with which the patron places wagers.

The HIC receives a request to fund an account and passes it to a PPC 1540 or directly to a bank using an interface provided by the PPC 1540 or bank 1550. In the example above of FIG. 15, a PPC 1540 is represented between the HIC and bank 1550. Different protocols and service interfaces are generally required for each type of bank card transaction. These interfaces may be provided via web services, direct IP connection to an IP socket, a software library installed on the HIC, or other method as specified by the PPC or Bank.

Through these interfaces, transaction requests and information are transported to/from the PPC 1540 or bank 1550. In the example of FIG. 15, a PPC 1540 is represented which can be, for example, a company such as Payment Tech, which is a Chase Company. The PPC 1540 interacts with one or more banking networks, which include national/international financial institution networks, such as STAR, NYCE, CIRRUS, INTERLINK or PLUS. The banking network is connected to a private banking network, which is the banking system or network of an individual private bank, more specifically the bank associated with the requested transaction, i.e., the wagerer's bank, credit institution, etc. The transaction is processed by the patron's bank using its own banking systems and processors and communicates back through the communication patch described above with an appropriate response, e.g., and approval or denial of a requested transaction. The details of the communication path and banking systems (e.g., "Network," "Payment Processor," "Banking Network,", "Private Banking Network," and "Banking Services") are known by those of ordinary skill in the art.

What is claimed is:

1. A method for funding players of a gaming system, comprising the steps of:

providing an interface whereby a player can interact with the gaming system;

allowing the player to request a transfer of funds from a bank account to a temporary personalized wagering account associated with the player via wagering account credentials and accessible by at least the interface and a host in charge configured for hosting gaming services and processing fund transfers wherein the personalized wagering account associated with the player is maintained by the host in charge and terminated at conclusion of a wagering session, and the interface accesses the personalized wagering account to obtain funds to encourage the player to use the personalized wagering account to fund game play through the same interface at which the request to transfer funds is made;

reading a bank card provided by the player; receiving the entry of a personal identification code; sending information regarding the player's request for a transfer of funds to a bank; and reporting to the player the bank's response to the player's request for a transfer of funds.

2. A method of funding players of a gaming system as in claim 1, wherein the interface is a terminal with an associated keypad.

3. A method of funding players of a gaming system as in claim 1, further comprising the step of indicating to the player the amount of funds in the wagering account.

4. A method of funding players of a gaming system as in claim 1, wherein said step of reading a bank card comprises allowing the player to swipe the bank card using the interface.

5. A method of funding players of a gaming system as in claim 1, wherein said step of sending information regarding the player's request for a transfer of funds to a bank further comprises sending the information to a payment processor.

6. A method of funding players of a gaming system as in claim 1, further comprising the step of verifying the player's wagering account credentials.

7. A method of funding players of a gaming system as in claim 1, further comprising the step of crediting the wagering account with the amount of the player's request for a transfer of funds from the bank account.

8. A method of funding players of a gaming system as in claim 1, further comprising the step of crediting the wagering account with an amount based on the player's winnings.

9. A method of funding players of a gaming system as in claim 8, further comprising transferring funds from the wagering account to the bank account.

10. A method of funding players of a gaming system as in claim 1, wherein the bank card is a debit card, check card, or credit card.

11. A method of funding players of a gaming system as in claim 1, wherein the personal identification code comprises a PIN.

12. A method of funding players of a gaming system as in claim 1, further comprising the step of classifying information provided by the player through the interface.

13. A terminal operated according to the method of claim 1.

14. A computer program product including instructions embodied on a non-transitory computer readable storage medium, the computer program product acting to allow for funding players of a gaming system, the computer program comprising:

allowing instructions for allowing a player to request a transfer of funds from a bank account to a temporary personalized wagering account associated with the player via wagering account credentials and accessible by at least the interface and a host in charge configured for hosting gaming services and processing fund transfers wherein the personalized wagering account associated with the player is maintained by the host in charge and terminated at conclusion of a wagering session, and the interface accesses the personalized wagering account to obtain funds to encourage the player to use the personalized wagering account to fund game play through the same interface at which the request to transfer funds is made;

reading instructions for reading a player's bank card;

receiving instructions for receiving the entry of a personal identification code;

sending instructions for sending information regarding the player's request for a transfer of funds to a bank; and reporting instructions for reporting to the player the bank's response to the player's request for a transfer of funds.

15. A wagering device with account funding, comprising:

a terminal configured for displaying a graphical user interface, the interface comprising prompts by which a player may request a transfer of funds from a bank account to a temporary personalized wagering account associated with the player via wagering account credentials and accessible by at least the interface and a host in charge wherein the personalized wagering account associated with the player is maintained by the host in charge and terminated at conclusion of a wagering session, and the interface accesses the personalized wagering account to obtain funds to encourage the player to use the personalized wagering account to fund game play through the same interface at which the request to transfer funds is made;

the host in charge configured for providing gaming services and processing fund transfers; and a network connecting said terminal and said host in charge, said network configured for communicating with a bank at which the bank account is provided.

16. A wagering device with account funding as in claim 15, further comprising a bank card reader connected to said terminal.

17. A wagering device with account funding as in claim 15, further comprising a keypad connected to said terminal.

18. A wagering device with account funding as in claim 15, further comprising a payment processor with which said network may communicate.

* * * * *